US006070719A

United States Patent [19]

Pollock

[11] Patent Number: 6,070,719

[45] Date of Patent: Jun. 6, 2000

[54] CARD AND GIFT BOX COMBINATION

[76] Inventor: Christopher S. Pollock, 6350 Gleason Rd., Shawnee, Kans. 66226

[21] Appl. No.: 09/347,595

[22] Filed: Jul. 1, 1999

[51] Int. Cl.[7] ..... B65D 69/00

[52] U.S. Cl. ..... 206/232; 206/459.5

[58] Field of Search ..... 206/232, 459.5; 229/92.8, 162; 40/312, 313

[56] References Cited

U.S. PATENT DOCUMENTS

| | | | |
|---|---|---|---|
| 1,143,729 | 6/1915 | Schmidt | 206/232 |
| 4,413,730 | 11/1983 | Morse | 206/232 |
| 4,700,831 | 10/1987 | Kassai | 206/232 |
| 5,004,271 | 4/1991 | Piatt . | |
| 5,038,930 | 8/1991 | Holtkamp, Jr. . | |
| 5,078,268 | 1/1992 | Olson et al. . | |
| 5,213,371 | 5/1993 | Bradley . | |
| 5,222,657 | 6/1993 | Holland, Jr. | 206/459.5 |
| 5,226,532 | 7/1993 | Davidson et al. . | |
| 5,289,917 | 3/1994 | Chabria . | |
| 5,433,317 | 7/1995 | Rosen | 40/312 |
| 5,458,235 | 10/1995 | Stone . | |
| 5,497,876 | 3/1996 | Fleming | 40/312 |
| 5,575,384 | 11/1996 | Saye . | |
| 5,586,659 | 12/1996 | Trumbo . | |
| 5,641,062 | 6/1997 | Burton et al. . | |
| 5,775,494 | 7/1998 | Taplin | 206/232 |
| 5,782,357 | 7/1998 | Johnson . | |
| 5,860,589 | 1/1999 | Hsu . | |

*Primary Examiner*—David T. Fidei
*Attorney, Agent, or Firm*—Chase & Yakimo, L.C.

[57] ABSTRACT

A greeting card and gift box combination made from a single sheet of cardboard-like box stock having a gift box member with a window for viewing a gift mounted therein, a greeting message on the gift box member above the window, a greeting card front flap hindedly attached to a side of the gift box member, an envelop cover integrated into the front flap to selectively hide a greeting or message viewable through a frame or window in the outside panel of the front flap, and a gift mount system for mounting a gift within the gift box member.

14 Claims, 4 Drawing Sheets

Fig. 1
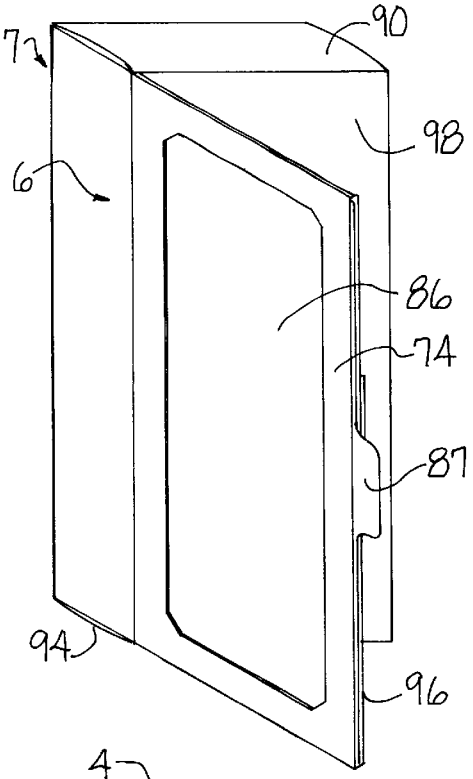
Fig. 3
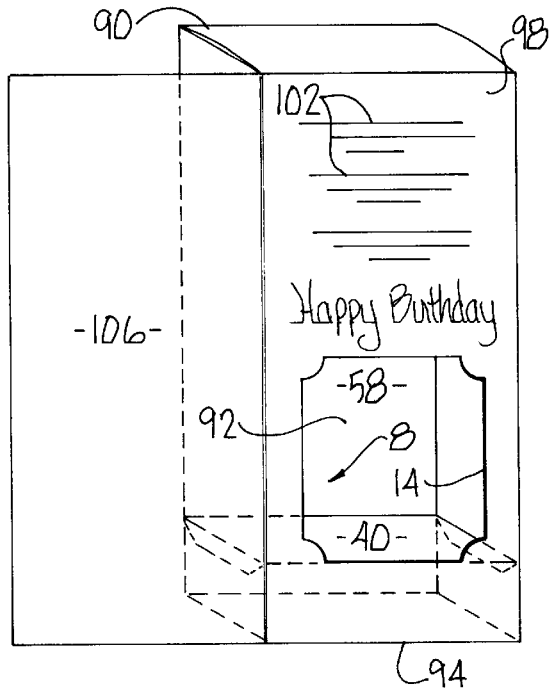
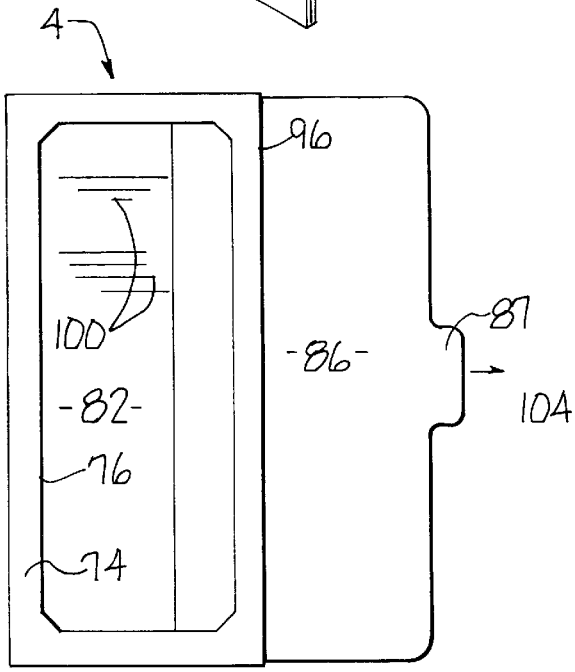
Fig. 2
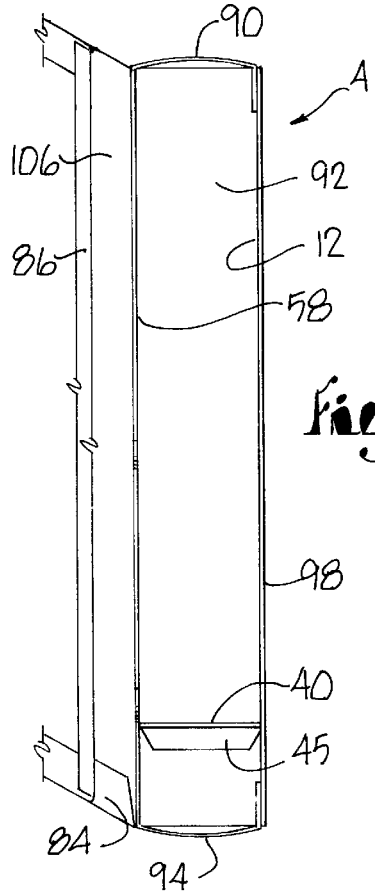
Fig. 4

11
12
14
16
18
20
22
24
26
28
32
34
36
38
40
42
44
46
48
50
52
54
56
58
59
60
61
62
64
66
68
70
72
74
75
76
78
80
81
82
83
84
85
86
87

CARD AND GIFT BOX COMBINATION

BACKGROUND OF THE INVENTION

The present invention relates to a gift product, and more particularly to a combination greeting card and adaptable gift box.

Various types of combination greeting card and gift boxes are known, as it is also known to accompany a gift with a greeting card. One such combination greeting card and gift box is disclosed in U.S. Pat. No. 5,458,235 to Stone.

One problem with known combination greeting card/gift boxes is that the message or greeting on the front of the product is exposed which reduces the enjoyment associated with the surprise and anticipation in receiving a gift and reading the greeting card message. Additionally, the gift is pre-packaged in the box with the greeting card which does not allow selection of a gift separate from the greeting card. Purchasing the card and gift together as a single product does not allow for individual tailoring of the greeting/gift combination to meet the unique needs of individuals and various situations.

It is desirable to provide a greeting card and gift box combination with an integrated envelope or cover to enhance the anticipation of the card/gift recipient by hiding the initial greeting/message. It is also desirable to provide a greeting card and gift box combination that has a separate gift mount to allow flexibility and individual selection of a gift to suit the needs and wishes of the gift giver and recipient.

SUMMARY OF THE INVENTION

It is, therefore, a primary object of the present invention to provide a combination greeting card/gift box that has an integrated envelope cover to hide the message on the outside of the greeting card.

Another important object of the present invention is to provide a combination greeting card/gift box that has a separate gift mounting system.

Still another important object of the present invention is to provide a combination greeting card/gift box that includes an integrated gift shelf to support a gift.

Yet another important object of the present invention is to provide a combination greeting card/gift box that is tailorable by the gift giver.

Still another important object of the present invention is to provide a combination greeting card/gift box that is assembled separately by the gift giver and then combined into a single integrated package.

And yet another important object of the present invention is to provide a combination greeting card/gift box that closely simulates a traditional greeting card by providing outside and inside message surfaces.

These and other objects of the present invention are achieved by providing a foldable cardboard blank having a plurality of foldable panels, wall flaps and adhesion tabs therein, the blank being easily foldable into a gift box configuration with a hinged cover flap. The hinged cover flap has a window into which a pull-out "envelope" cover is received through a side opening in the flap. When the slideable cover is removed from the flap, the outer surface as seen through the window of the flap reveals a message relating to some special occasion printed thereon (like the front of a standard greeting card). When the cover flap is opened, an inside message (like the inside of a standard greeting card) and a partially opened compartment into which a gift that corresponds to the messages is stored, are exposed. The inside message is on the surface that partially closes the compartment. The gift is releasably secured to a gift mount which is secured within the partially opened compartment. A mounting shelf may be secured within the compartment below the opening to provide support for the gift mount.

BRIEF DESCRIPTION OF THE DRAWINGS

FIG. 1 is a front perspective view of a combination greeting card/gift box in accordance with the present invention showing the front flap partially open and the envelope cover in place within the front flap.

FIG. 2 is an elevation view of the combination greeting card/gift box of FIG. 1 showing the envelope cover partially removed from the front flap and exposing the outside message.

FIG. 3 is a front perspective view of the combination greeting card/gift box of FIG. 3 showing the gift compartment window and the inside message surface.

FIG. 4 is a left side perspective view of the combination greeting card/gift box of FIG. 3 with the side panel removed to show the gift mounting shelf and gift compartment.

DETAILED DESCRIPTION

Figure 8:
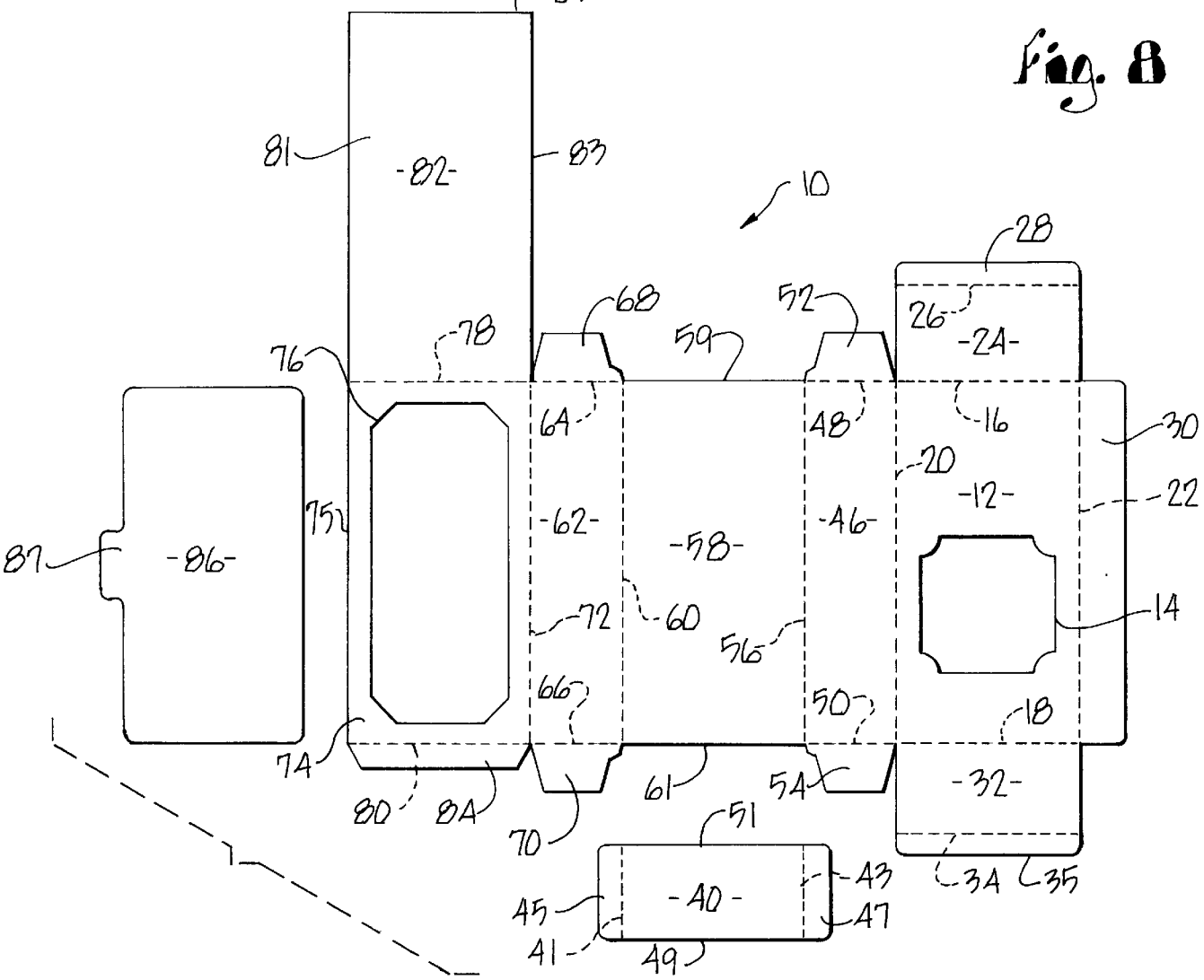
FIG. 8 is a plan view of a blank for the combination greeting card/gift box of FIG. 1.

Turning more particularly to the drawings, FIGS. 1–4 show a preferred embodiment of the card and gift box combination 4 of the present invention. FIG. 8 illustrates a plan view of the cardboard blank 10 for the card and gift box combination 4.

Card and gift box combination 4 includes a front flap assembly 6, gift box assembly 7 and gift mount 8. The front flap assembly 6 presents the equivalent of a conventional envelope and greeting card opening flap. The front flap assembly 6 is hinged, preferably along the left side edge of the gift box assembly 7 as shown. The gift box assembly 7 presents a greeting card inside flap and gift box.

More specifically, the front flap assembly 6 includes the front cover panel 74, front message panel 82, flap 84 and envelope cover 86. As shown, rectangular front cover panel 74 as best seen in FIG. 8 is defined by free edge 75 laterally spaced from fold line 72 and vertically spaced-apart upper 78 and lower 80 horizontal fold lines. The front cover panel 74 has an aperture 76 formed therein which presents a window or frame through which the front message panel 82 is viewable.

Front message panel 82 is connected to the front cover panel 74 at fold line 78 and includes laterally spaced-apart vertical free edges 81 and 83, a horizontal free edge 85 vertically spaced from the fold line 78 and message indicia 100. The front cover panel flap 84 is connected to the cover panel 74 at fold line 80.

Flap 84 is adhesively secured to front message panel 82 to form a slot or pocket 96 between the front cover panel 74 and front message panel 82. Envelope cover 86 is sized to be slidably received and withdrawn from within the slot 96 at free edge 81 thereby acting as a cover over indicia 100.

The envelope cover 86 includes a tab 87 extending from a side thereof for easy movement of the envelope cover 86 within the slot 96. As an alternative to indicia 100, a conventional greeting card (not shown) may be inserted in the slot 96 at free edge 83 such that the card's front cover is viewable through window 76.

The gift box assembly 7 forms a box having a compartment 92 in which a gift (not shown) may be stored until opened by the intended recipient. As shown, the gift box assembly 7 is rectangular but it may take any shape. The gift box assembly 7 includes front and rear panels 98 and 58, side panels 46 and 62 and top and bottom panels 24 and 32. The front panel 98 includes a second inside message indicia 102 on the outer surface thereof and has an opening 14 formed therein which presents a window for viewing a gift mounted within the box compartment 92.

Figure 5:
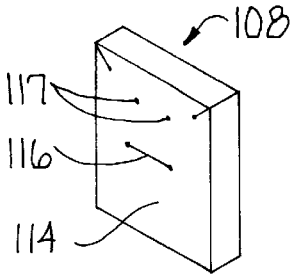
FIG. 5 is a front perspective view of an alternative gift mount for a greeting card/gift box in accordance with the present invention.
Figure 6:
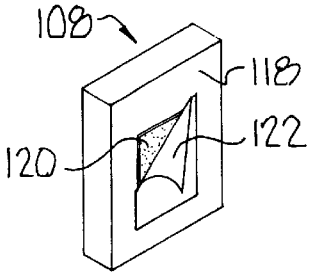
FIG. 6 is a rear perspective view of the gift mount of FIG. 5 showing a partially exposed adhesive mounting.

The gift mount 8 includes a gift shelf 40 securely mounted within the gift box preferably below or adjacent the window 14 of the gift box's front panel 98. Gift shelf 40 may include apertures or slots (not shown) for securing a gift thereto. The gift mount 8 may additionally or alternatively include gift hanger 108 as shown in FIGS. 5–7.

Gift hanger 108 consists of a cardboard box adapted to fit within window 14 in front panel 98. The gift mount front panel 114 has a slot 116 and apertures 117 therein adapted to facilitate securing a gift thereto, such as a pair of earrings and a necklace (not shown). The rear panel 118 of gift hanger 108 has an adhesive backing 120 covered by a releasable tape 122 adapted to adhesively secure the gift hanger 108 within the compartment 92 on the back panel 58.

Figure 7:
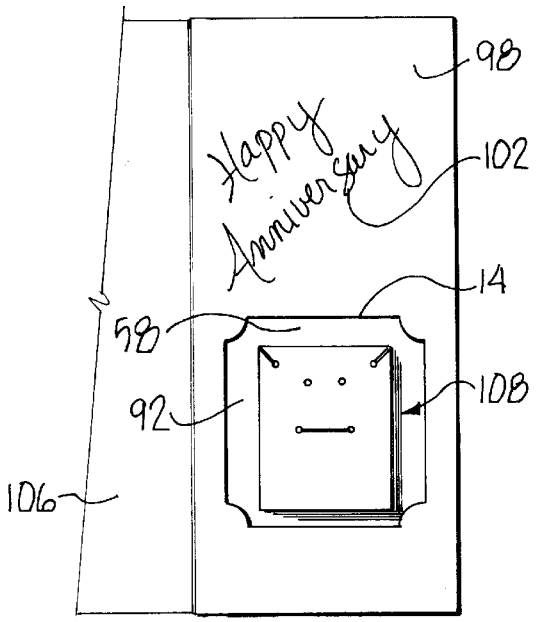
FIG. 7 is a front view of a combination greeting card/gift box in accordance with the present invention showing the gift mount of FIG. 5 fixed to the rear wall of the gift compartment and showing the inside message surface.

In the example shown in FIG. 7, the words "Happy Anniversary" are printed on front panel surface 98 as the inside message indicia 102 just above window 14. Gift hanger 108 can be seen (along with the mounted gift if present) through window 14.

In use and initially referring to FIG. 1, envelope cover 86 is fully engaged in slot 96 covering message indicia 100. Referring to FIG. 2, as envelope cover 86 is pulled by tab 87 along direction arrow 104, front message panel 82 is exposed to display front panel message indicia 100 through window 76. After outer message indicia 100 is read, the front of card/gift combination 4 is opened in a similar manner as opening a greeting card as shown in FIG. 3. Inside message indicia 102 on front panel surface 98 and compartment 92 are exposed. An additional message (not shown) may be placed on the rear surface 106 of front message panel 82. FIG. 4 shows card/gift combination 4 with the left side panel removed to view the compartment 92 and shelf 40 mounted therein.

Blank 10 is preferably formed from a single sheet of cardboard-like box stock. 3-D card/gift box combination 4 is assembled by folding adhesive tab 30 forward along fold line 22 until it is perpendicular to front panel 12. Front panel 12 is folded forward along fold line 20 until it is perpendicular to right side panel 46. Right side panel 46 is folded forward along fold line 56 until it is perpendicular to back panel 58. Left side panel 62 is folded forward along fold line 60 until it is perpendicular to back panel 58. Adhesive flap 30 is adapted to be adhesively secured to the inside surface of left side panel 62 when card/gift box combination 4 is being formed.

End flaps 52, 54, 68 and 70 are folded inward along fold lines 48, 50, 64 and 66 until they are perpendicular to their associated side panels 46 and 62. Top panel 24 is folded rearward along fold line 16 to form a top 90 of the card/gift combination 4 as shown in FIGS. 1, 3 and 4. Top panel flap 28 is folded inwardly along fold line 26 adjacent back panel 58 to close the top of gift compartment 92.

To form the bottom 94, flap 35 is folded rearward along fold line 34 and inserted into compartment 92 adjacent back panel 58. Shelf panel 40 is defined by laterally spaced-apart vertical fold lines 41 and 43, and vertically spaced-apart horizontal free edges 49 and 52. Extending from fold lines 41 and 43 are flaps 45 and 47 respectively. Shelf panel 40 may be inserted into compartment 92 through aperture 14 in front panel 12. Flaps 45 and 47 are adapted to be adhesively secured to left 62 and right 46 side panels respectively such that free edge 49 is adjacent front panel 12 and free edge 51 is adjacent back panel 58. In this manner, shelf panel 40 may be placed at any level within compartment 92 or left out entirely to accommodate various sized gifts (not shown).

Front cover panel 74 is folded outward along fold line 72 until it is perpendicular to left side panel 62. Front message panel 82 is folded forward onto front cover panel 74 until front message panel free edge 85 is adjacent fold line 80. Flap 84 is folded along fold line 80 into contact with the proximate free edge 85 of the front message panel 82 and is adhesively secured to front message panel 82 thus forming a slot 96 between front cover panel 74 and front message panel 82.

Figure 9:
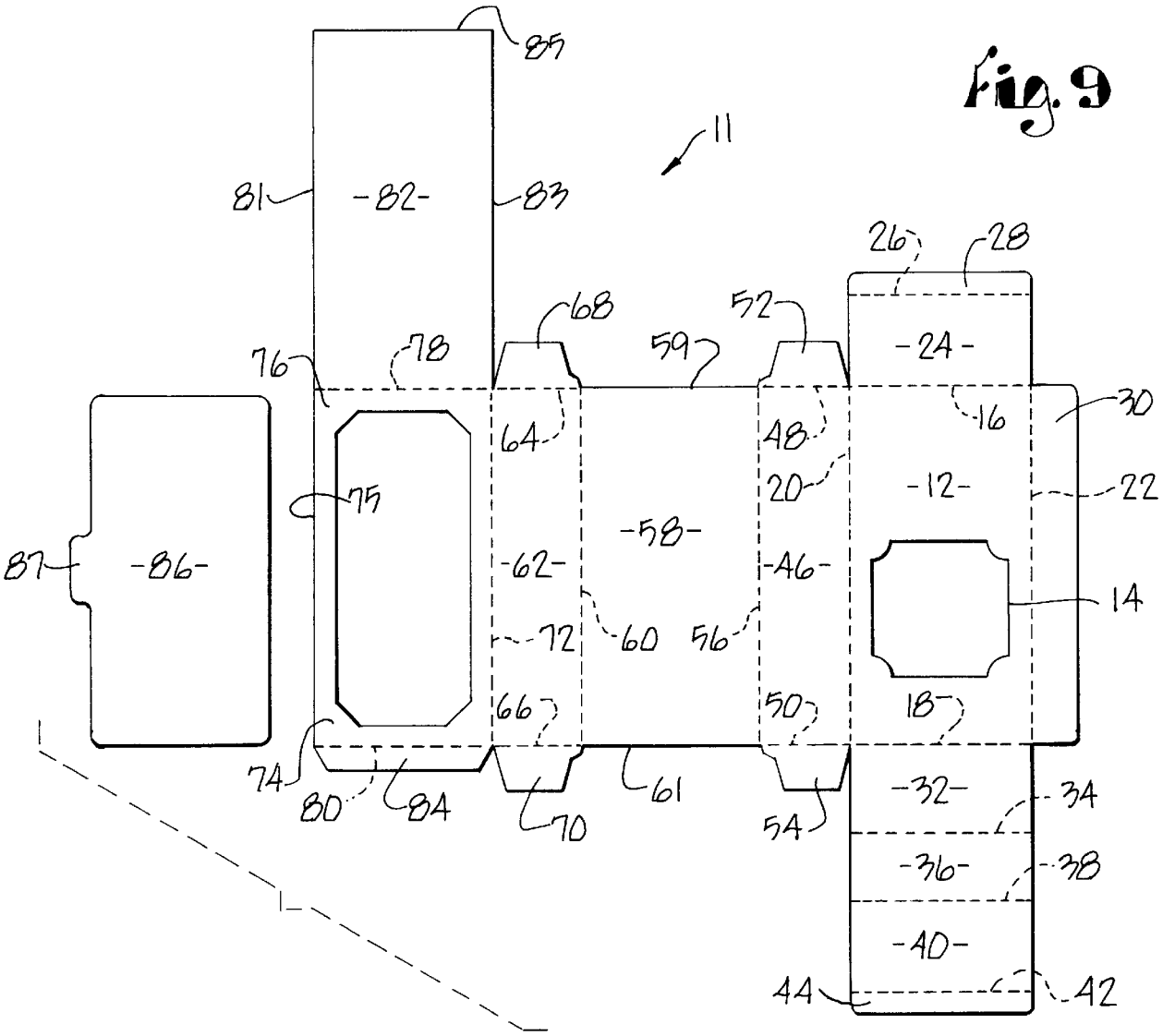
FIG. 9 is a plan view of an alternate blank for the combination greeting card/gift box of FIG. 8.

A modified form of the blank 10 for the card/gift combination 4 is illustrated in FIG. 9. Blank 11 is similar to blank 10 shown in FIG. 8. However, rectangular gift shelf panel 40 is integral to bottom panel 32. Bottom panel 32 is folded rearward along fold line 18 to form a bottom 94 of card/gift combination 4. Rear shelf panel 36 is folded inwardly along fold line 38 adjacent back panel 58 to close the bottom of gift compartment 92. Shelf panel adhesive flap 44 is folded forward along fold line 42 until it is perpendicular to gift shelf panel 40. Gift shelf panel 40 is folded forward along fold line 38 until adhesive flap 44 is adjacent front panel 12 inside container 92. Adhesive flap 44 is adhesively secured to front panel 12 inside container 92 immediately below window 14.

This invention lends itself to a wide variety of special designs adapted to the characteristics of the particular gift article and the nature of the greeting. Thus, according to the present invention, a card/gift combination has been provided within which a common personal sentiment, such as a birthday greeting as to the card portion of the invention, is combined with a gift box within which a gift is displayed.

This invention may be sold as a kit, offering a variety of different types of gift mounts, such as those described herein.

Having thus described the invention, what is claimed as new and desired to be secured by Letters Patent is as follows:

1. A greeting card and gift box combination, comprising:

a gift box member;

an envelope member hingedly attached to said gift box member along a side thereof; and a gift mount secured within a compartment of said gift box member;

said envelope member including a front flap, a slot formed in said flap and a cover member, said front flap presenting a window through which a first indicia is viewable and said cover member adapted to be slidably inserted and withdrawn from said slot to selectively hide and expose said first indicia at said window;

said gift box member having a front surface with a second indicia thereon and an opening formed therethrough presenting a second window for viewing a gift mounted to said gift mount, said second indicia and said opening being viewable when said envelope member is opened.

2. A greeting card and gift box combination as claimed in claim 1 wherein:

said envelope member further comprises a second slot opposite said slot;

said second slot adapted to slideably accept a greeting card having a front cover wherein said greeting card front cover is viewable through said front flap window.

3. A greeting card and gift box combination as claimed in claim 1 wherein said gift box member and said envelope member are formed from a one-piece foldable blank.

4. A greeting card and gift box combination as claimed in claim 1 wherein said gift box member, said envelope member and said gift mount are formed from a one-piece foldable blank.

5. A greeting card and gift box combination as claimed in claim 1 wherein said envelope member further comprises an inside surface having a third indicia thereon, said third indicia being viewable when said envelope member is opened.

6. A greeting card and gift box combination comprising:

a one-piece blank foldable to form a gift box member and an envelope member hingedly attached to said gift box member along a side thereof;

a plurality of gift mounts for selectively securing at least one of said gift mounts within a compartment of said gift box member;

said envelope member having a front flap, a slot formed in said flap and a cover member, said front flap presenting a window through which a first indicia is viewable and said cover member adapted to be slideably inserted and withdrawn from said slot to selectively hide and expose said first indicia at said window;

said gift box member having a front surface with a second indicia thereon and an opening formed therethrough presenting a second window for viewing a gift mounted to an at least one of said gift mounts secured therein; and said envelope member being pivotal between a closed position in which said member covers said gift box member front surface and an open position in which said second indicia and said opening being viewable.

7. A greeting card and gift box combination as claimed in claim 6 wherein at least one of said gift mounts is part of said one-piece blank.

8. A greeting card and gift box combination as claimed in claim 6 wherein said first indicia and said second indicia are birthday greetings.

9. A greeting card and gift box combination as claimed in claim 6 wherein said envelope member further comprises an inside surface having a third indicia thereon, said third indicia being viewable when said envelope member is in said open position.

10. A one-piece combined greeting card and gift package blank comprising:

a rectangular front panel having an aperture therein;

a rectangular bottom panel foldably connected to said front panel along a lower horizontal fold line;

a rectangular top panel foldably connected to said front panel along an upper horizontal fold line spaced from said bottom panel;

a top panel flap foldably connected to said top panel along an upper horizontal fold line spaced from said front panel;

a front panel adhesive flap foldably connected to said front panel along a vertical fold line;

a first rectangular side panel foldably connected to said front panel along a vertical fold line spaced from said front panel flap;

a first side panel lower tab foldably connected to said first side panel along a lower horizontal fold line;

a first side panel upper tab foldably connected to said first side panel along an upper horizontal fold line spaced from said first side panel lower tab;

a rectangular back panel foldably connected to said first side panel along a vertical fold line spaced from said front panel;

a second rectangular side panel foldably connected to said rear panel along a vertical fold line spaced from said first side panel;

a second side panel lower tab foldably connected to said second side panel along a lower horizontal fold line;

a second side panel upper tab foldably connected to said second side panel along an upper fold line spaced from said second side panel lower tab;

a rectangular front cover panel foldably connected to said second side panel along a vertical fold line spaced from said back panel, said front cover panel having an aperture therein;

a front cover flap foldably connected to said front cover along a lower horizontal fold line;

a rectangular front message panel foldably connected to said front cover panel along an upper horizontal fold line spaced from said front cover flap; and a rectangular cover panel having a tap protruding from a vertical free edge, said cover panel adapted to cover said front panel aperture.

11. A one-piece combined greeting card and gift package blank as claimed in claim 10, further comprising:

a rectangular gift shelf having a first and a second vertical spaced-apart fold line;

a first and a second gift shelf adhesive flaps foldably connected to said gift shelf first and second vertical fold lines respectively; and said gift shelf adapted to be adhesively secured to said first and second side panels.

12. A one-piece combined greeting card and gift package blank as claimed in claim 10, further comprising:

a gift mount box adapted to be adhesively secured to said rear panel.

13. A one-piece combined greeting card and gift package blank as claimed in claim 10, further comprising:

a bottom panel flap foldably connected to said bottom panel along a horizontal fold line spaced from said front panel.

14. A one-piece combined greeting card and gift package blank as claimed in claim 10 further comprising:

a rectangular rear gift panel foldably connected to said bottom panel along a horizontal fold line spaced from said front panel;

a rectangular shelf gift panel foldably connected to said rear gift panel along a horizontal fold line spaced from said bottom panel;

a shelf gift panel adhesive flap foldable connected along a horizontal fold line spaced from said shelf gift panel, said shelf gift flap adapted to be adhesively secured to said front panel below said front panel aperture.

* * * * *